US007677835B2

(12) United States Patent
Oscar

(10) Patent No.: US 7,677,835 B2
(45) Date of Patent: Mar. 16, 2010

(54) DRAINAGE CELL MODULAR RAINTANK AND WATER STORAGE SYSTEM

(76) Inventor: Larach Oscar, P.O. Box 4022, Castlecrag, NSW (AU) 2068

( * ) Notice: Subject to any disclaimer, the term of this patent is extended or adjusted under 35 U.S.C. 154(b) by 608 days.

(21) Appl. No.: 11/534,603

(22) Filed: Sep. 22, 2006

(65) Prior Publication Data

US 2007/0217866 A1 Sep. 20, 2007

(30) Foreign Application Priority Data

Mar. 14, 2006 (AU) ..... 2006901293
Mar. 14, 2006 (AU) ..... 2006901294

(51) Int. Cl.
*E02B 13/00* (2006.01)

(52) U.S. Cl. ..... 405/39; 405/36; 405/45

(58) Field of Classification Search ..... 405/39, 405/43–50; 52/630
See application file for complete search history.

(56) References Cited

U.S. PATENT DOCUMENTS

| | | | |
|---|---|---|---|
| 4,483,640 A | 11/1984 | Berger et al. | |
| 4,619,366 A | 10/1986 | Kreeger | |
| 4,842,142 A | 6/1989 | Kreeger | |
| 4,932,532 A | 6/1990 | Apps et al. | |
| 5,287,966 A | 2/1994 | Stahl | |
| 5,339,979 A | 8/1994 | Box | |
| 5,472,297 A | 12/1995 | Heselden | |
| 5,809,720 A | 9/1998 | Sauve | |
| 5,810,509 A | 9/1998 | Nahlik, Jr. | |
| 6,186,345 B1 | 2/2001 | Robertson | |
| 6,361,248 B1 | 3/2002 | Maestro | |
| 6,648,549 B1 | 11/2003 | Urriola | |
| 6,779,946 B1 * | 8/2004 | Urriola et al. | 405/43 |

FOREIGN PATENT DOCUMENTS

| | | |
|---|---|---|
| CN | 1208800 A | 2/1999 |
| EP | 1205390 A2 | 5/2002 |
| EP | 1205391 A1 | 5/2002 |
| EP | 1437305 B1 | 12/2005 |
| NL | EP0943737 A1 * | 9/1999 |
| WO | WO 01/29334 A1 | 4/2001 |
| ZA | 9800512 A | 1/1998 |

* cited by examiner

*Primary Examiner*—David J Bagnell
*Assistant Examiner*—Benjamin Fiorello
(74) *Attorney, Agent, or Firm*—Trojan Law Offices

(57) ABSTRACT

A modular raintank and water storage system are described. A modular raintank comprises a plurality of interconnected external sidewall modules. The sidewall modules have a plurality of openings which allow water to freely flow into and out of the modular raintank. The water storage system comprises a plurality of interconnected modular raintanks. The adjacent modular raintanks of the water storage system can share a sidewall, and can be stacked on top of each other and connected in a side-by-side pattern. The shared sidewall comprises a plurality of locking lip members arranged in rows to facilitate the attachment of additional modular plates of adjacent raintanks and a plurality of U-shaped openings to facilitate visual inspection of the tank while underground.

16 Claims, 18 Drawing Sheets

DRAINAGE CELL MODULAR RAINTANK AND WATER STORAGE SYSTEM

CLAIM OF PRIORITY

This application claims priority to Australian provisional application No. 2006901293, filed Mar. 14, 2006, and to Australian provision application No. 2006901294, filed Mar. 14, 2006.

FIELD OF THE INVENTION

The present invention relates to modular infiltration or rain tanks, leach drains or channels, and in particular, to systems of modular infiltration tanks used to store water.

BACKGROUND OF THE INVENTION

Underground infiltration tanks and leach drains are formed from plastic perforated tank cells, which are butted or stacked together to form a tank of required size, and are wrapped in geotextile and surrounded in good draining medium such as sand. The geotextile allows water to pass therethrough but stops any sand or soil from passing therethrough. Thus, storm water flows into the infiltration tank via a connecting pipe or infiltration, and percolates into the surrounding strata through the geotextile-covered perforated walls of the tank. Similarly, water infiltrates through the soil above the tank and enters the tank through the geotextile-covered top perforated wall of the tank.

To form a reuse or water-harvesting tank, the above tank system is surrounded on the base and sides by a water impervious sheet. To assist in lowering transportation cost, most of the prior art infiltration tanks and leach drains modules are formed by joining together multiple wall plates, and the tanks or modules are typically transported in stacks of plates. These plates are of two types—a male plate having pins located on the periphery—and a female plate having recesses with which the pins engage.

As there is only a frictional engagement between the pins and the recesses, the pins can disengage if the plates flex. In addition, the presently used raintanks have an inherent weakness to side soil pressure once underground, particularly on the male plate side. This weakness occurs because the tank is held together by the interconnection of small plastic pins of the male plate with matching openings on the larger female plate. Such interconnection weakens the tank module and can lead to structural failure of the tank.

In addition, the presently utilized raintank modules utilize a plurality of thin interconnecting support struts, having small flow-through openings therebetween. These support struts are positioned very closely together, in order to provide stronger structural support against the force of the soil. However, such close proximity of the interconnecting struts prevents one from accessing the inside of the tank for inspection purposes, such as for example, with a camera.

The present invention seeks to overcome the above-described problems of the prior art by providing new modular plates for an underground raintank.

SUMMARY OF THE INVENTION

In one form, the invention provides a modular plate member for forming an underground infiltration or storage system, comprising:

a first planar member having an alternating pattern of support surfaces and openings in a checker board like pattern;

a second planar member spaced from and parallel to said first planar member, and having an alternating pattern of support surfaces and openings in a checker board like pattern, with each opening of the second planar member aligning with a support surface of the first planar member and with each support surface of the second planar member aligning with an opening of the first planar member;

joining members connecting the support surface of one planar member to the adjacent support surfaces of the other plate;

a periphery wall extending between the edges the first and second planar members;

first openings located in the periphery wall;

locking members extending outwardly from the periphery walls; and second openings in at least some of the support surfaces of the first and second planar members located adjacent the edges thereof, whereby the locking members of one plate member pass through and lock behind the first or second openings in the other plate member to lock the plate members together, to resist separation.

In one embodiment of the present invention the locking members have side protrusions which lock behind the openings to resist separation of the plates.

In another embodiment of the present invention there are provided additional openings in the central row of the support surfaces into which locking members of another plate member can be locked to lock another plate thereto.

In a further form of the invention provides a modular plate member for forming an underground rainwater infiltration or storage system, comprising:

a first planar member having an alternating pattern of openings and octagonal support surfaces in a checker board like pattern;

a second planar member spaced from and parallel to said first planar member, and having an alternating pattern of openings and octagonal support surfaces in a checker board like pattern, with each openings of the second planar member aligning with an octagonal support surface of the first planar member and with each octagonal support surface of the second planar member aligning with an opening of the first planar member;

columnar members located at the corners of the octagonal support surfaces of one plate member connecting to the corners of the adjacent octagonal support surfaces of the other planar member;

a periphery wall extending between the edges the first and second planar members;

first openings located in the periphery wall;

second openings located in at least some of the support surfaces of the first and second planar members located adjacent the edges thereof, locking members extending outwardly from the periphery walls and having protrusions extending laterally therefrom beyond one of the dimensions of the first and second openings; and whereby the locking members of one plate member pass through and the protrusions lock behind the first or second openings in the other plate member to lock the plate members together, to resist separation.

In another preferred embodiment, the invention is a modular raintank structure comprising:

a plurality of sidewall plate modules, said sidewall plate modules interconnected to form a box-shaped raintank with a hollow interior space;

a plurality of internal plate modules extending within the hollow interior space of said raintank between opposing sidewall plate modules;

each of said sidewall plate modules and internal plate modules including a skeletal framework of a plurality of interconnecting struts, said struts having openings therebetween;

wherein water can freely flow into and out of said modular raintank through said openings.

In one form of the above embodiment, the interconnecting struts of the sidewall plate modules are nonparallel.

In yet another preferred embodiment, the present invention is a modular water storage system comprising:

a plurality of interconnected raintank modules, each of said raintank modules having a plurality of external sidewall plate modules forming a box-like shape with a hollow interior;

each raintank module including a plurality of internal plate modules extending within the hollow interior of said raintank module between opposing sidewall plate modules;

each of said sidewall plate modules and internal plate modules including a skeletal framework of a plurality of interconnecting struts, said struts having openings therebetween; and wherein water can freely flow into and out of said modular raintank through said openings.

In one variation of the above embodiment, at least two of the interconnected raintank modules in the water storage system share a common sidewall.

In another variation of the above embodiment, at least one of the raintank module in the water storage system is stacked on top of another raintank module.

In yet another preferred embodiment, the invention is a modular wall panel for an underground infiltration tank, comprising:

a rectilinear periphery formed of four edge members;

a plurality of longitudinally running strut members extending between said periphery edge members;

a plurality of transversely running strut members extending between said edge members and intersecting said longitudinally running strut members;

a plurality of diagonally extending strut members extending between said edge members and intersecting said longitudinally and said transversely running strut members;

a plurality of locking lip members, said locking lip members being arranged in a plurality of rows extending between said edge members, said plurality of locking lip members being adapted to interlock with corresponding locking members of at least one additional modular plate, thereby connecting said modular wall panel with said additional modular plates.

In one variation of the above embodiment, the modular wall panel includes a plurality of strut members extending from the peripheral edge members and forming an opening between themselves and the peripheral edge member from which they extend.

BRIEF DESCRIPTION OF THE DRAWINGS

The invention will now be described by way of example with reference to the following figures, in which.

DETAILED DESCRIPTION OF THE INVENTION

The following discussion describes in detail several embodiments of the present invention and multiple variations of those embodiments. This discussion should not be construed, however, as limiting the invention to those particular embodiments. Practitioners skilled in the art will recognize numerous other embodiments as well.

Figure 1A:
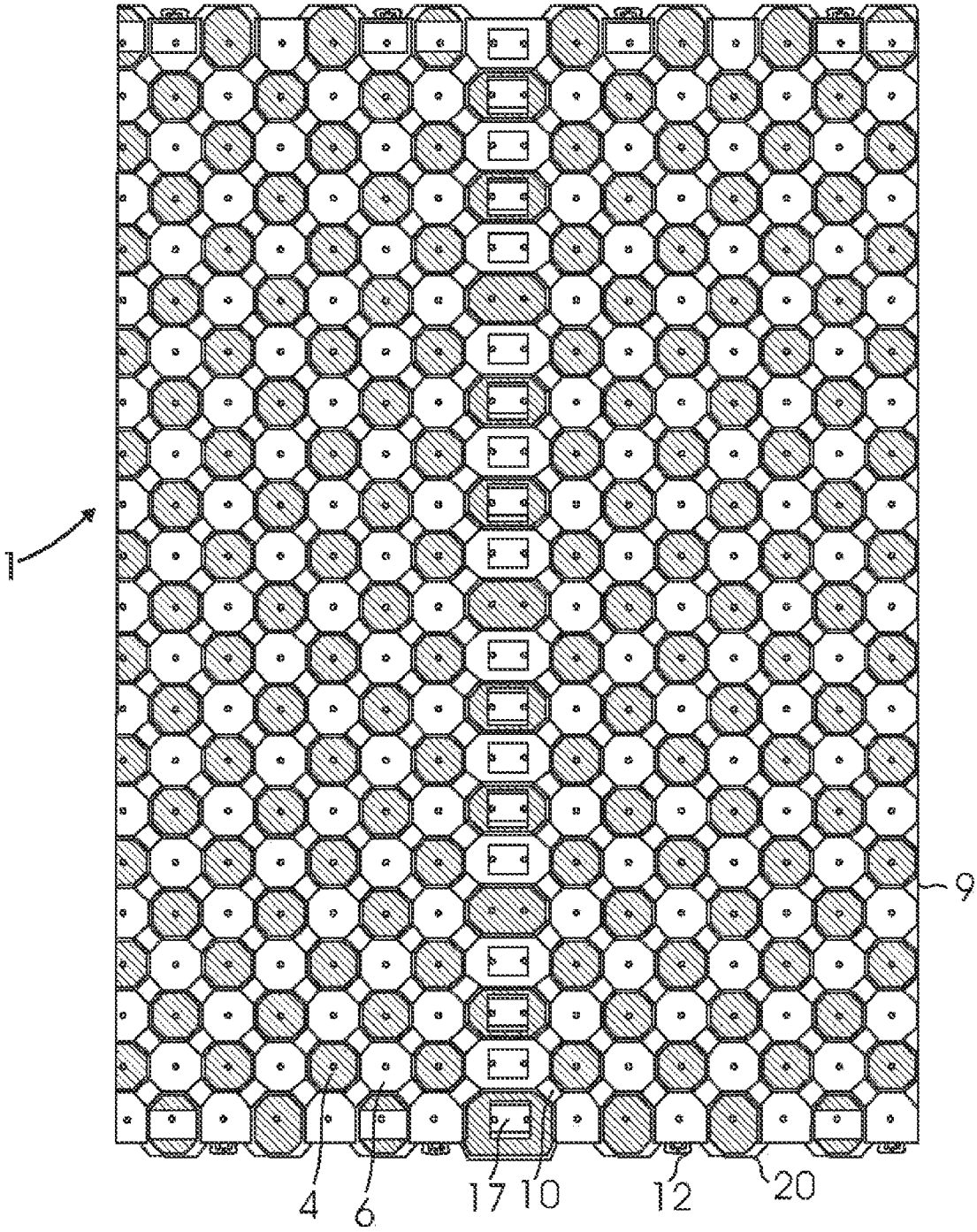
FIG. 1A illustrates a plan view of a modular cell plate according to one embodiment of the present invention.
Figure 1B:
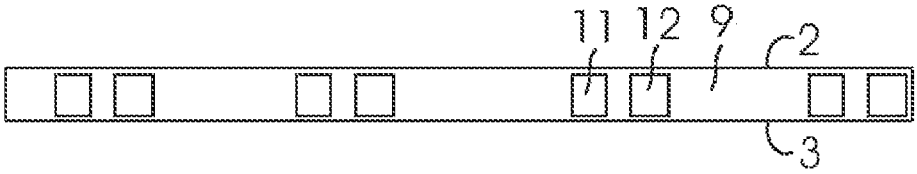
FIG. 1B illustrates a side view of the modular cell plate of FIG. 1A.
Figure 2:
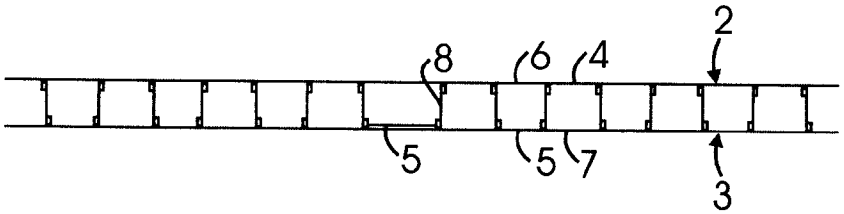
FIG. 2 is a cross sectional view of the modular cell plate of FIG. 1A taken along section I-I.

FIGS. 1A and 1B, 2, and 3 illustrate one embodiment of the modular wall panel (cell plate) of the present invention. Referring to FIGS. 1A, 1B and 2, modular cell plate 1 comprises two opposed planar members 2 and 3. The top planar member 2 comprises an array of octagonal support surfaces 4 alternating with openings 6 in a checkerboard pattern. This pattern is reproduced on bottom planar member 3 with the octagonal support surfaces 4 of the top planar member 2 overlaying the openings 7 of the bottom planar member 3, and the openings 6 of the top planar member 2 overlaying the octagonal support surfaces 5 of the bottom planar member 3. In addition, the top planar member 2 contains square openings 10 which overlay the square openings 10 of the bottom planar member 3.

Referring to FIG. 2, columnar supports 8 connect each corner of the support surfaces 4 of the upper planar member 2 with the respective corners of adjacent support surfaces 5 of the lower planar member 3.

Referring back to FIG. 1A and FIG. 1B, a periphery wall 9 extends around cell plate 1, extending between the edges of the top planar member 2 and bottom planar member 3. The periphery wall 9 includes cut outs 11 and locking members 12. Edge support surfaces 20 are positioned adjacent the periphery wall 9. Referring to both FIG. 1A and FIG. 3, the edge support surfaces 20 are shaped so as to form a castellated edge with cut outs 21 similar to the cut outs 11.

Figure 3:
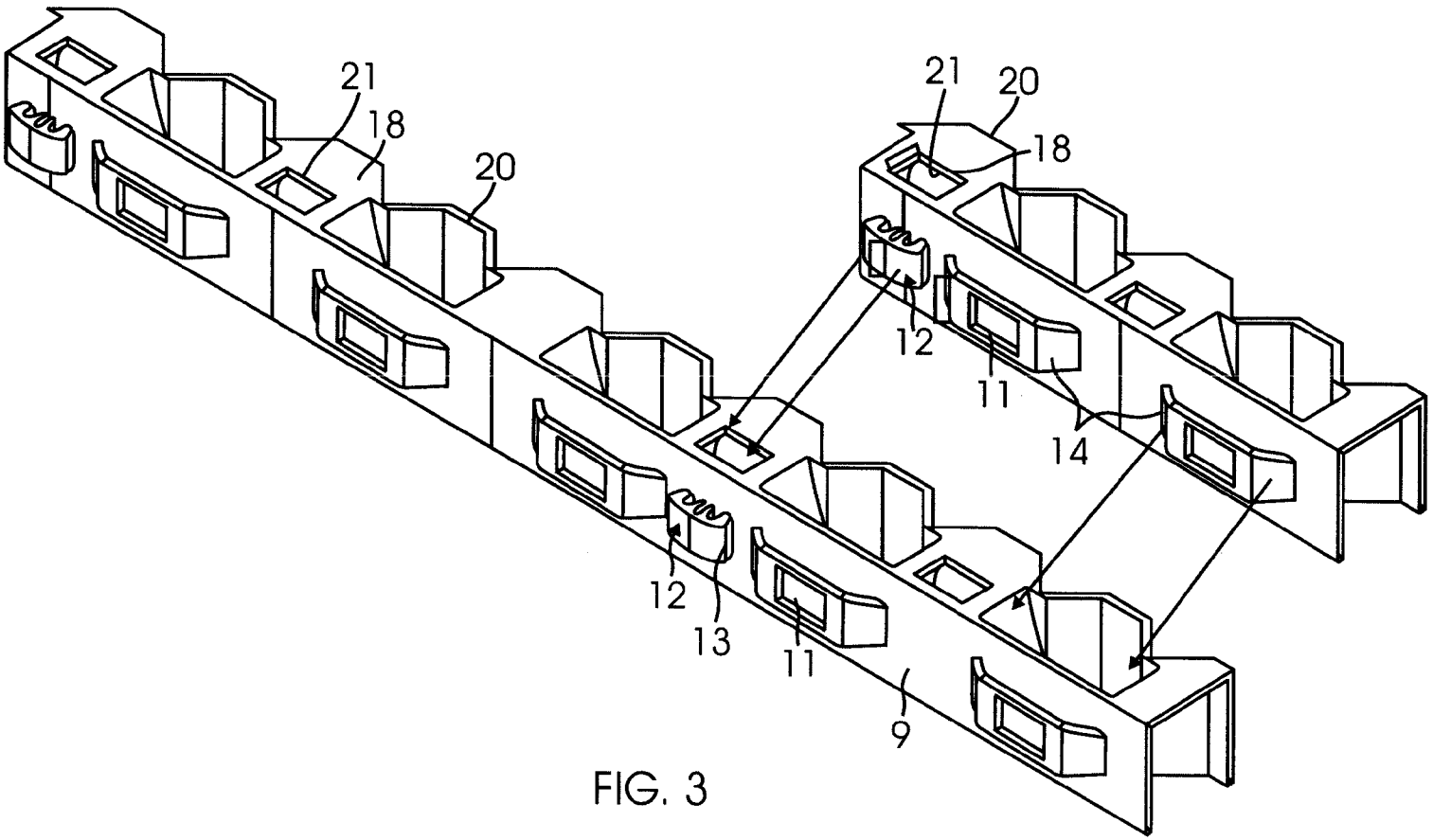
FIG. 3 illustrates a perspective view of the locking mechanism as shown in FIG. 1A and FIG. 1B.
Figure 4:
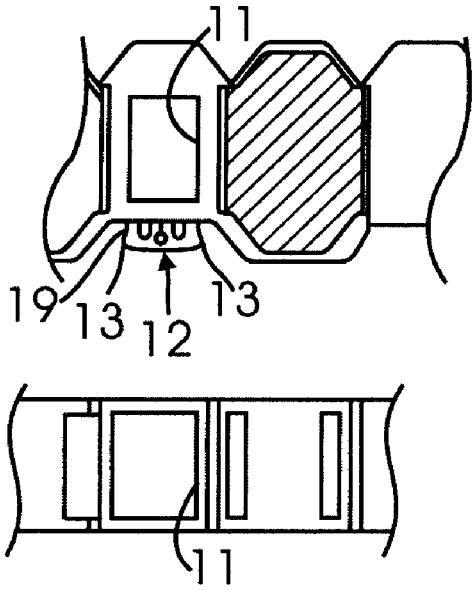
FIG. 4 illustrates a detailed view of the locking mechanism as shown in FIGS. 1A and 1B, and 3.
Figure 5:
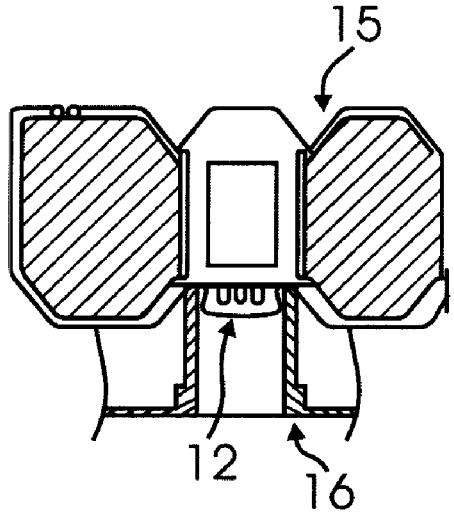
FIGS. 5 & 6 illustrate the locking operation between plates.
Figure 6:
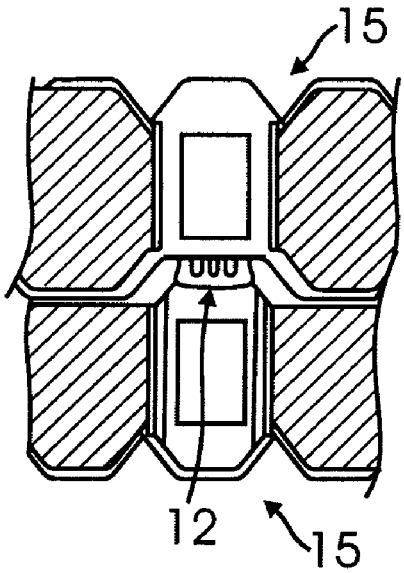

Referring to FIGS. 3 and 4, locking members 12 have protrusions 13, which extend wider than the size of the width of the cut outs 11 and 21. Hence, as shown in FIGS. 5 and 6, when cell plates are pressed together, the locking members 12 are compacted. As locking members 12 pass through cut outs 11 and 21, the protrusions 13 spring back and lock behind the cell plate wall 14 surrounding the cut outs 11. In effect, as shown in FIG. 4, the neck 19 of the locking member 12 is compressed and tensioned, urging the protrusions 13 against the wall 14 on both sides of the opening and resisting the withdrawal of the locking member 12.

Referring to FIGS. 3 and 5, a vertical cell plate 15 can lock into a horizontal cell plate 16 when the locking members 12 engage with the edge holes 21 which are formed in the edge support members 18. Alternatively, as illustrated in FIG. 6, two vertical 15 or two horizontal plates 16 can lock together.

Referring back to FIG. 1A, additional cut outs 17 are located on the central row of support surfaces 4 & 5, such that another cell plate (not shown) can be connected to cell plate 1. It will be appreciated that these cut outs 17 can be located not only on the central row of support surfaces, but can be located on any of the horizontal or vertical rows of support surfaces of cell plate 1 to accommodate the connection of one or several other cell plates to cell plate 1.

Figure 7:
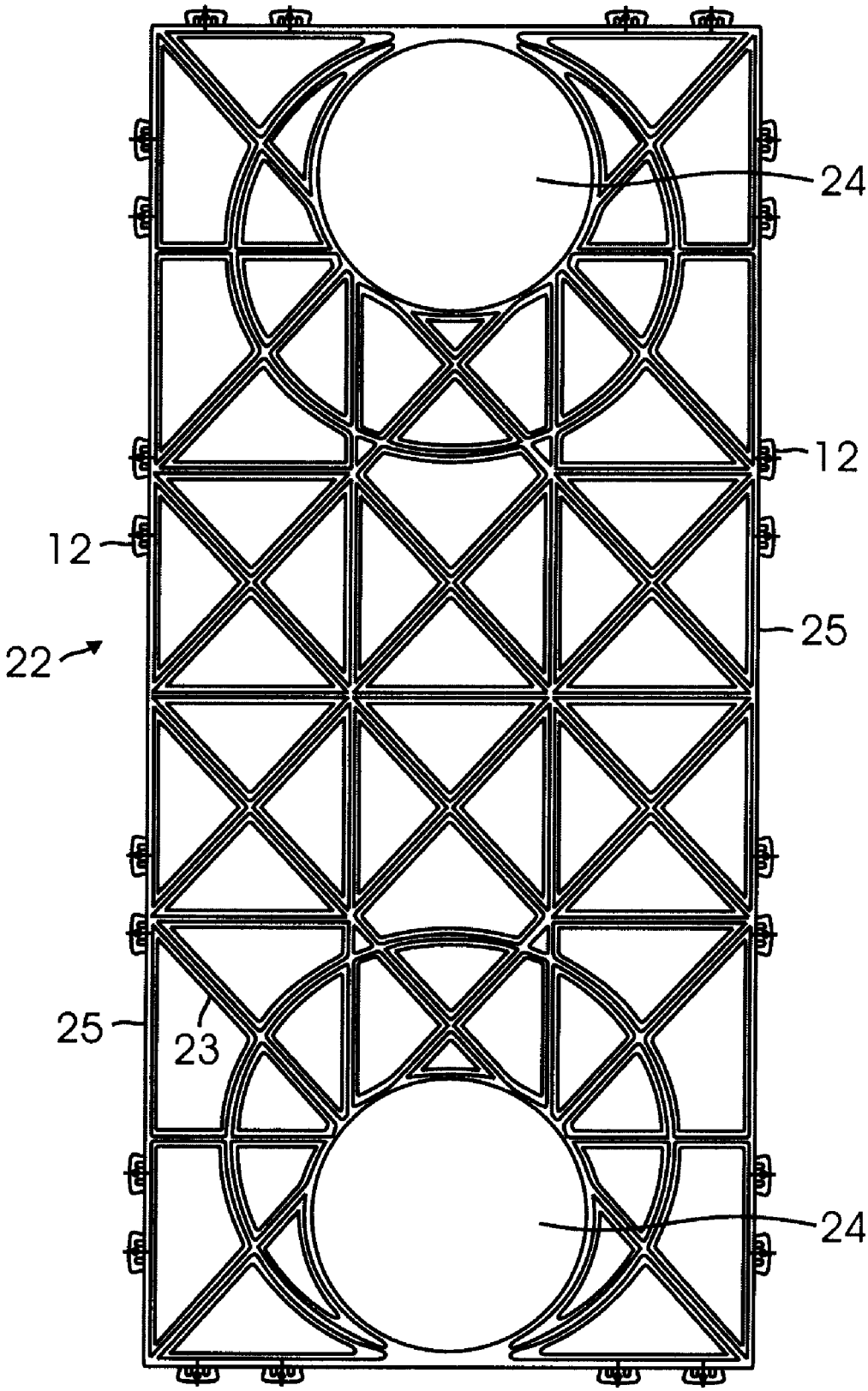
FIG. 7 illustrates a transverse plate according to one embodiment of the present invention.
Figure 9:
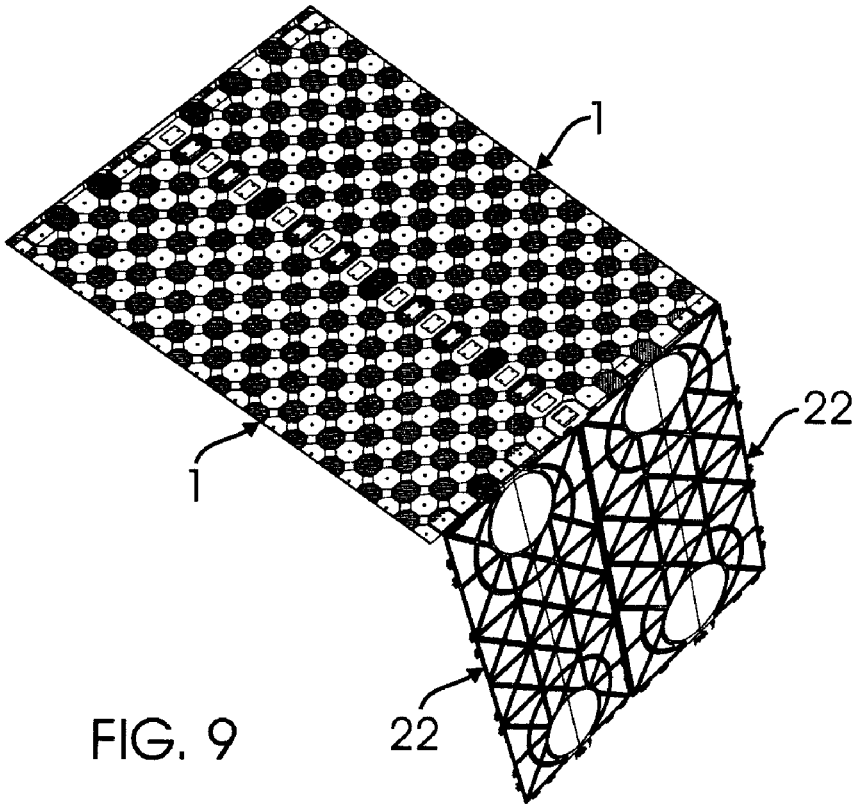
FIG. 9 illustrates schematically the joining of two cross plates to a modular cell plate in the process of forming a tank module.

FIG. 7 illustrates another embodiment of the invention. Referring to FIG. 7, cross plate 22 comprises a skeletal framework of reinforced thin struts 23 that have openings therebetween. The cross plate 22 also has two circular apertures 24. Locking members 12 are positioned on outer walls 25 of the cross plate 22. Thus, several plates 22 can be connected to each other (not shown) on any one of their sides or can alternatively be connected to plates such as plate 1 of FIG. 1A, as shown in FIG. 9. As a result, a tank module can be formed of any number of cell plates and cross plates to form a tank module three or more cell plates high or wide.

Figure 8:
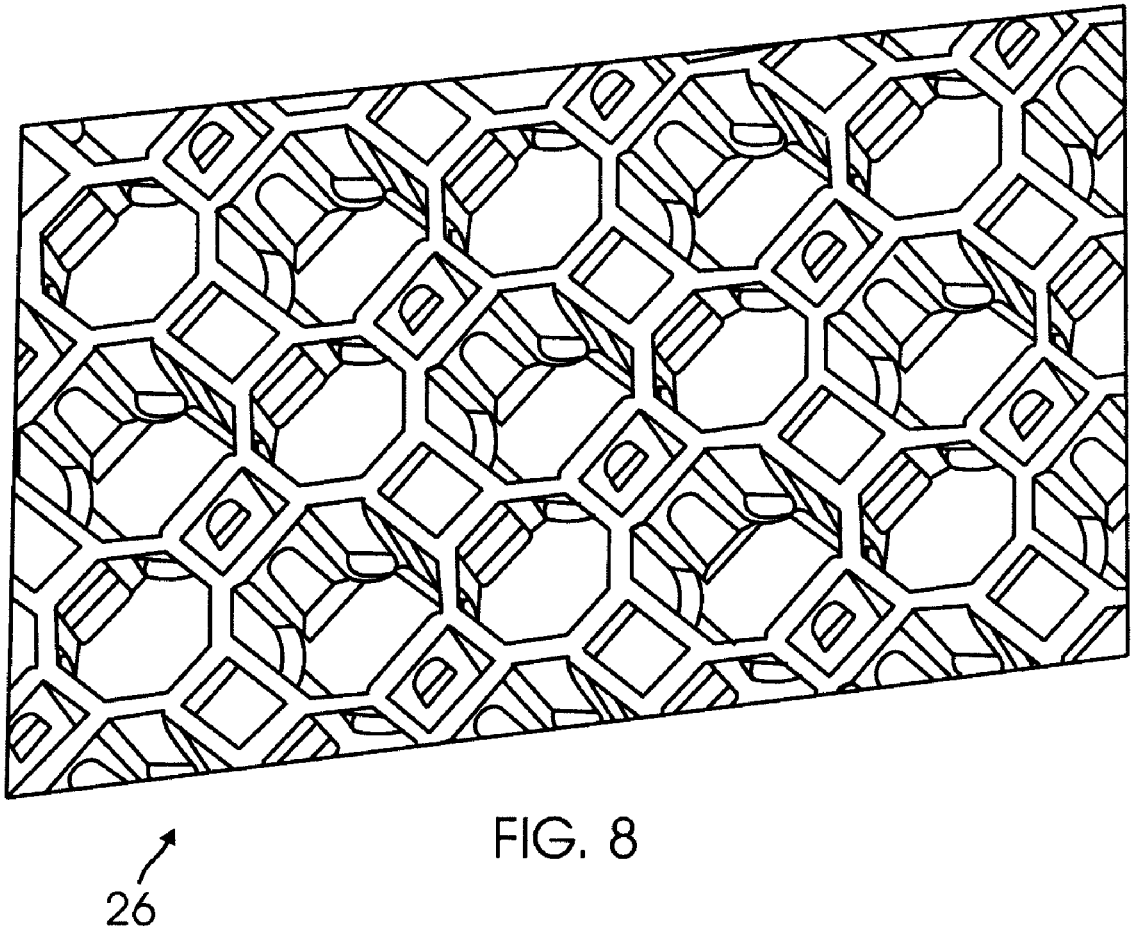
FIG. 8 illustrates a modular cell plate according to another embodiment of the invention.

FIG. 8 illustrates another embodiment of the present invention wherein the octagonal support surfaces are replaced by an octagonal framework, with all other features being same as previously described.

Figure 10A:
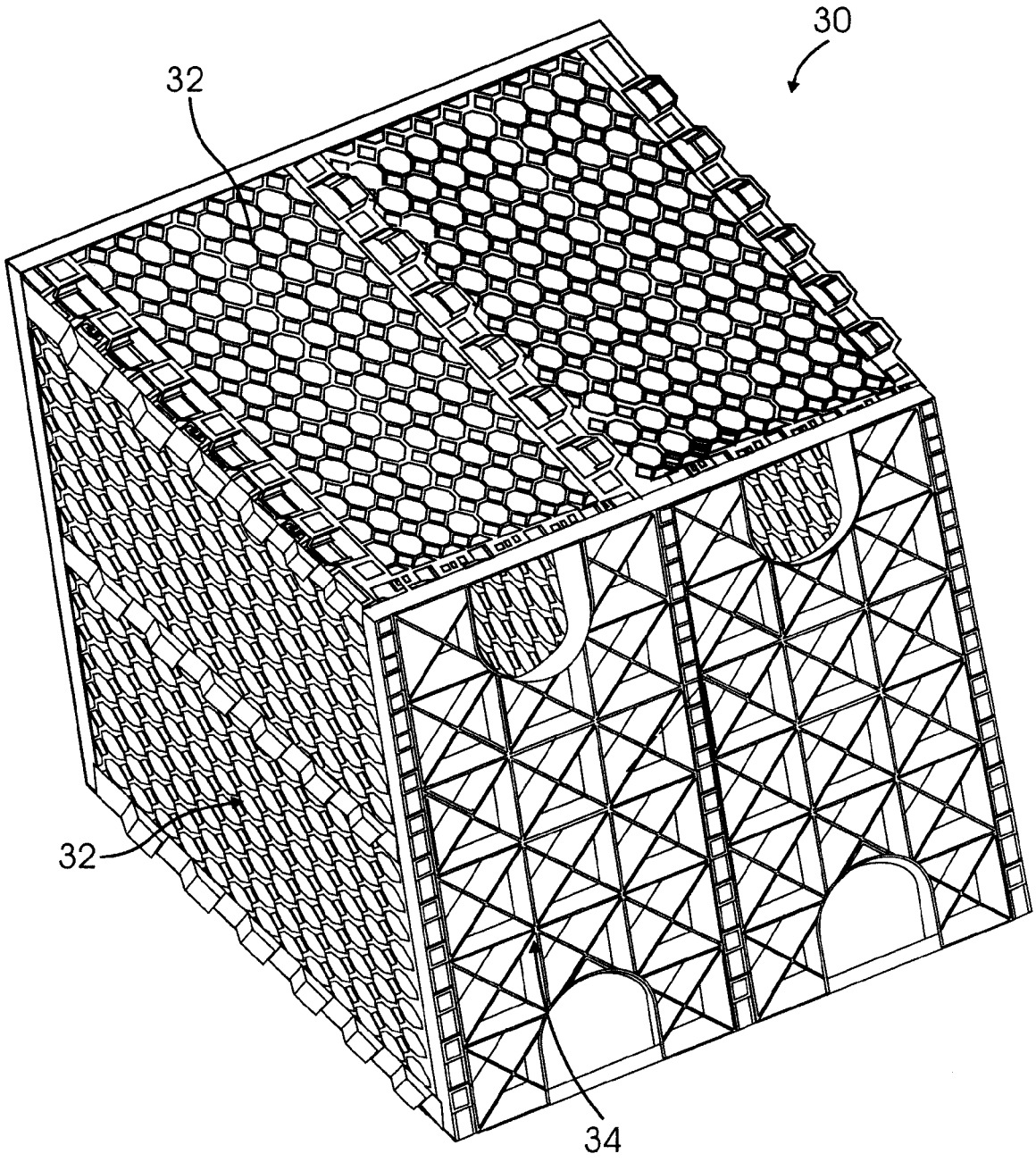
FIG. 10*a* is a perspective view of a fully assembled raintank module.

FIG. 10*a* illustrates an assembled tank module in accordance with the present invention. Tank module 30 is cube-like in shape and has a hollow interior. Tank module 30 contains six sidewalls. Four of the sidewalls are comprised of modular cell plates 32. In the embodiment illustrated in FIG. 10*a*, modular cell plates 32 are similar to cell plate shown in FIG. 1A, but contain a pattern of interconnecting strut members as illustrated in FIG. 8. However, it will be appreciated by one of ordinary skill in the art that modular cell plate 1 or cell plates with a different pattern of interconnecting members can be used instead. Referring to FIG. 10*a*, the remaining two sidewalls of tank module 30 are comprised of two end plates 34.

Figure 10B:
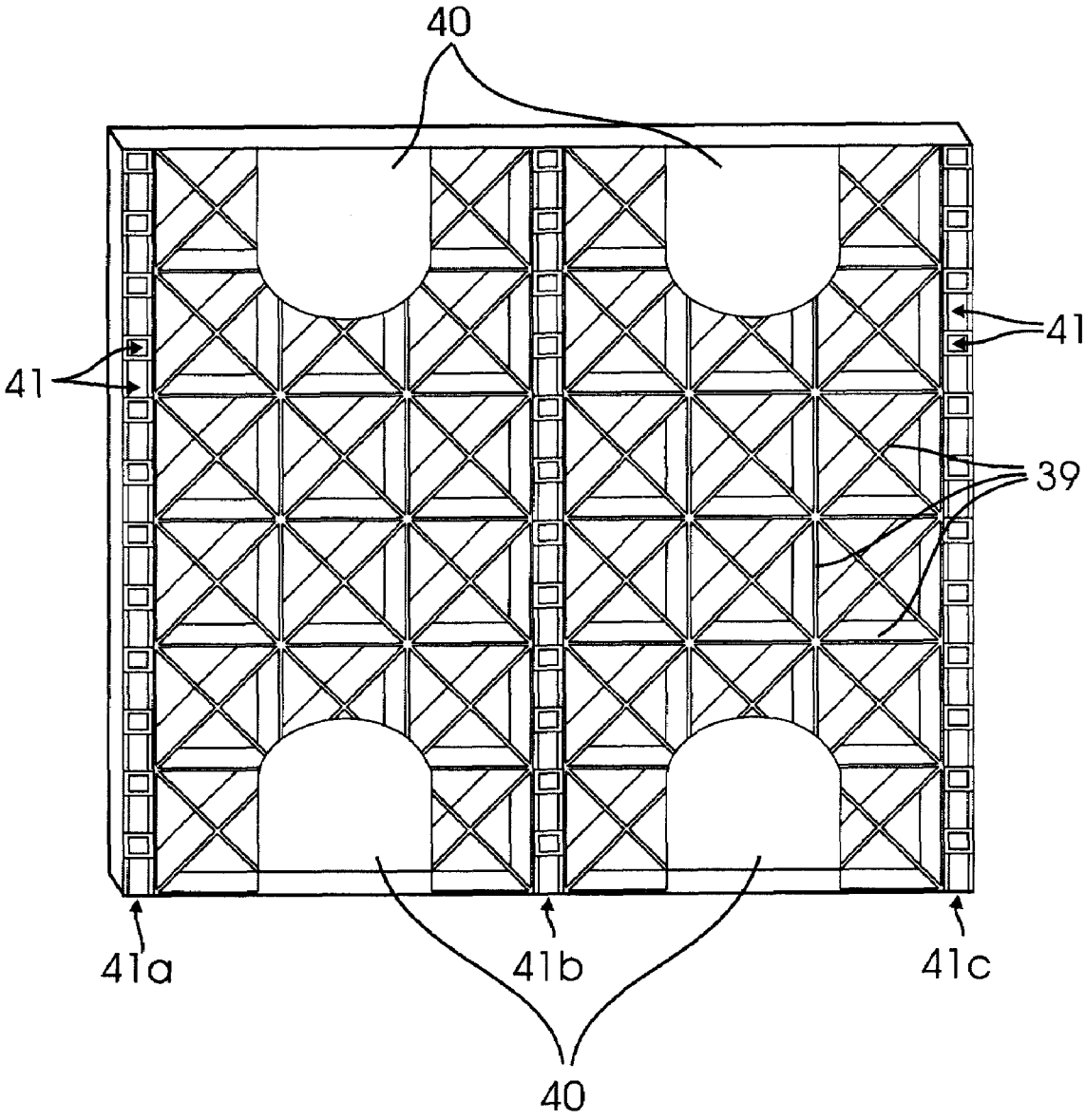
FIG. 10*b* is a front view of a modular end plate according to one embodiment of the present invention.

The end plate 34 of the invention is illustrated in more detail in FIG. 10*b*. Similarly to cross plate 22, end plate 34 comprises a skeletal framework of reinforced thin struts 39 that have openings therebetween. In the embodiment illustrated in FIG. 10*b*, four of the thin struts 39 are U-shaped. Unlike cross plate 22, which has two circular apertures 24, the end plate 34 in the illustrated embodiment has four horseshoe shaped apertures 40, formed by the aforementioned four U-shaped thin struts extending from and back to the peripheral edge members.

The U-shaped openings 40 in end plate 34 provide an advantage over the plates of the prior art in that they allow the user to access the inside of a raintank once it is underground. For example, a cable with a video camera on its end may be inserted into any of the U-shaped openings 40 and the entire inside of the raintank may be examined for structural integrity.

The end plate 34 is also unlike cross-plate 22 in that it does not have locking members protruding from its outer walls. Instead, as seen in FIG. 10*b*, end plate 34 includes locking lip members 41 oriented in three rows 41*a*, 41*b* and 41*c* and extending along the entire length of end plate 34. The locking lip members 41 provide an advantage over protruding clip members of the modular plates of the prior art in that they allow for a much stronger connection between the end plate 34 and modular cell plates, as will be further discussed below.

Figure 10C:
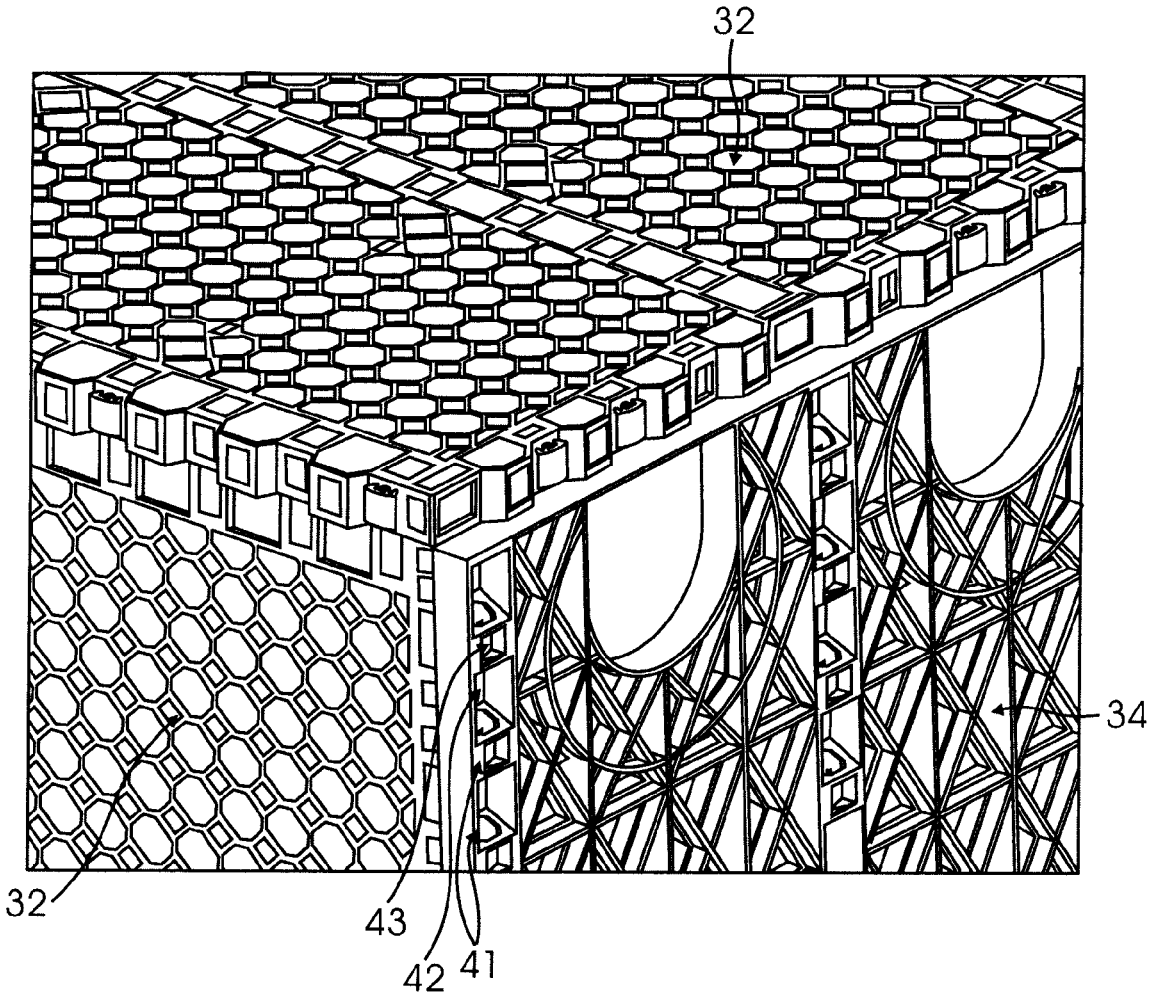
FIG. 10C is a perspective close-up view of the connection between the modular cell plates and the modular end plate of the present invention.
Figure 13A:
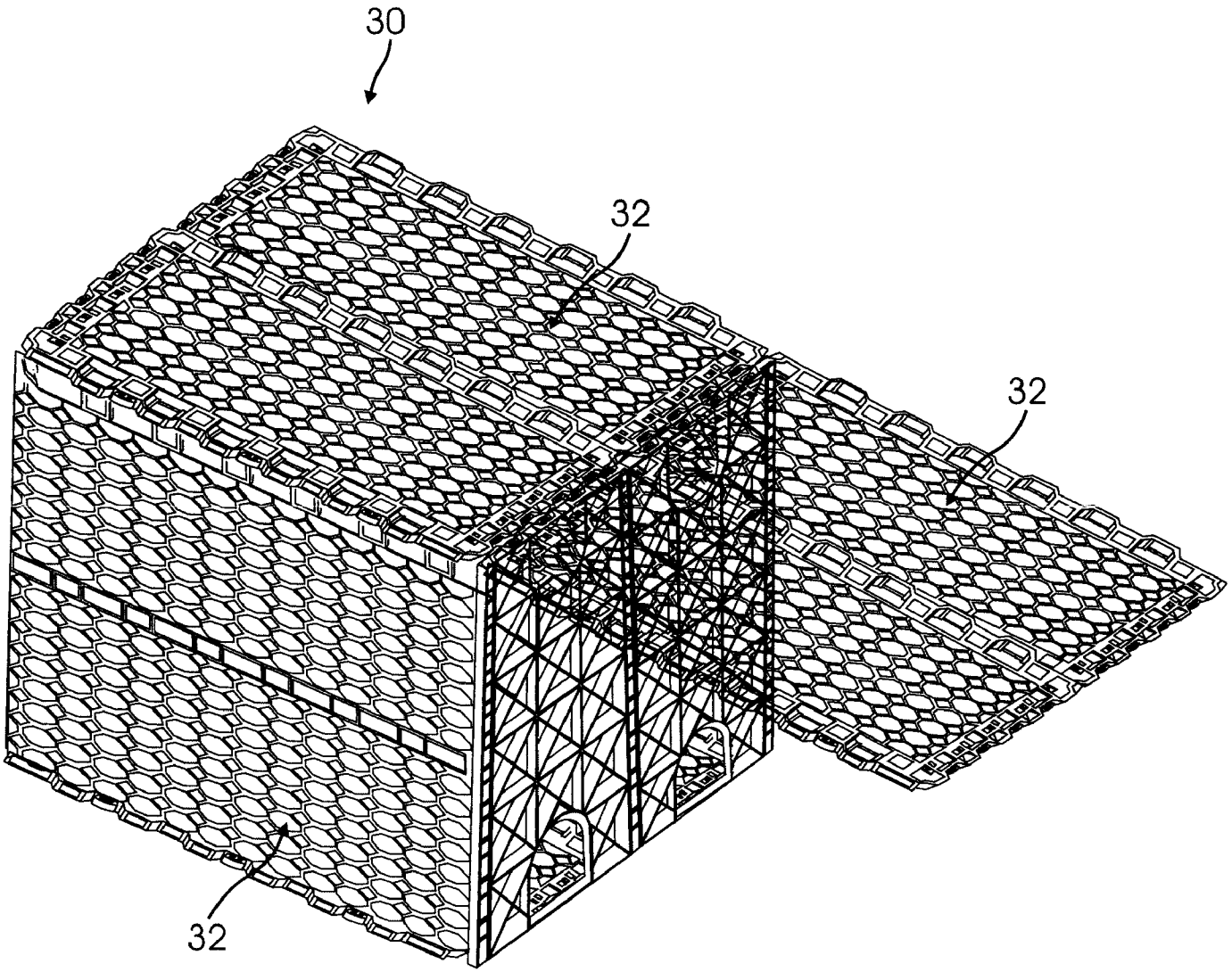
FIG. 13*a* is a perspective view of a fully assembled first raintank module and the first modular cell plate of a second raintank module being connected to an end plate of the first raintank module.
Figure 13B:
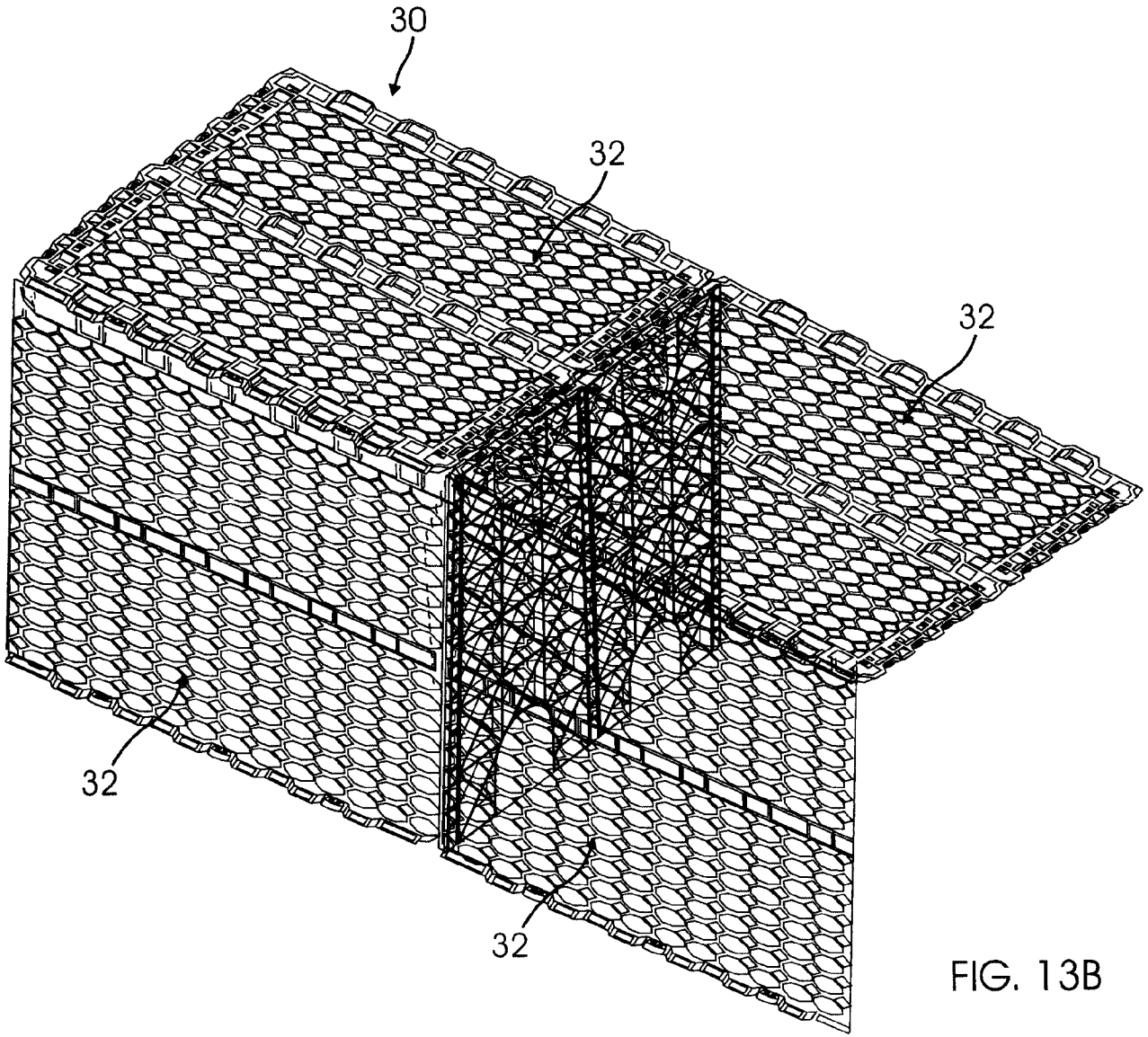
FIG. 13*b* is a perspective view of a fully assembled first raintank module and the first two modular cell plates of a second raintank module being connected to an end plate of the first raintank module.
Figure 13C:
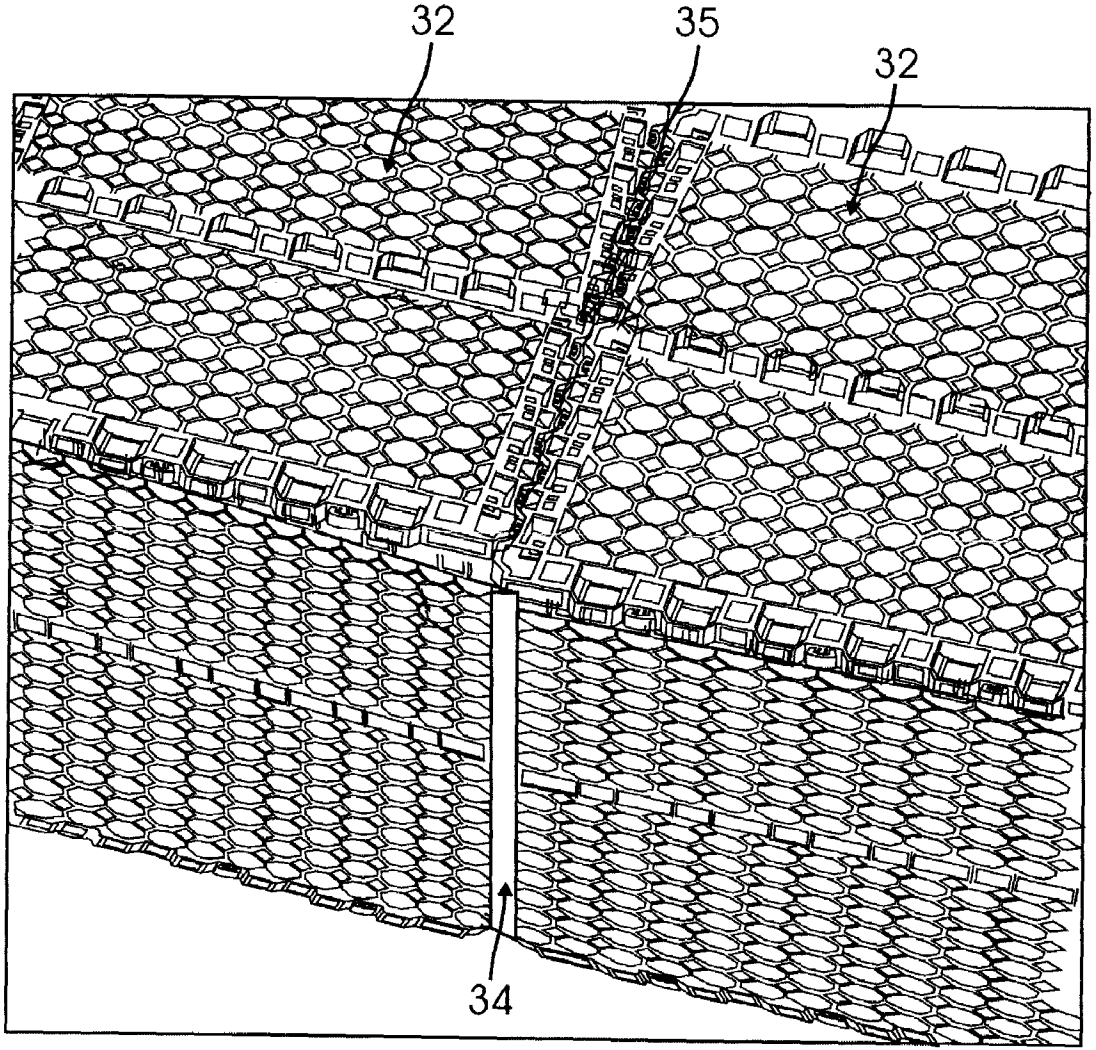
FIG. 13*c* is a close-up view of a fully assembled first raintank module and the first two sidewalls of a partially assembled second raintank module being connected to an end plate of the first raintank module.

Referring to FIG. 10*c*, the locking lip members 41 are adapted to mate with matching locking members 42 and periphery wall members 43 of cell plate 32. The locking lip members 41 of end plate 34 are configured such that two cell plates 32 can be simultaneously connected to both sides of end plate 34, through the interconnection between locking lip members 41 of end plate 34 and the matching locking members 42 and periphery wall members 43 of cell plates 32. This interconnection is also illustrated in FIGS. 11B, 13B, and 13C, and allows for two modular raintanks to be connected to each other utilizing end plate 34 as a common sidewall.

Figure 11A:
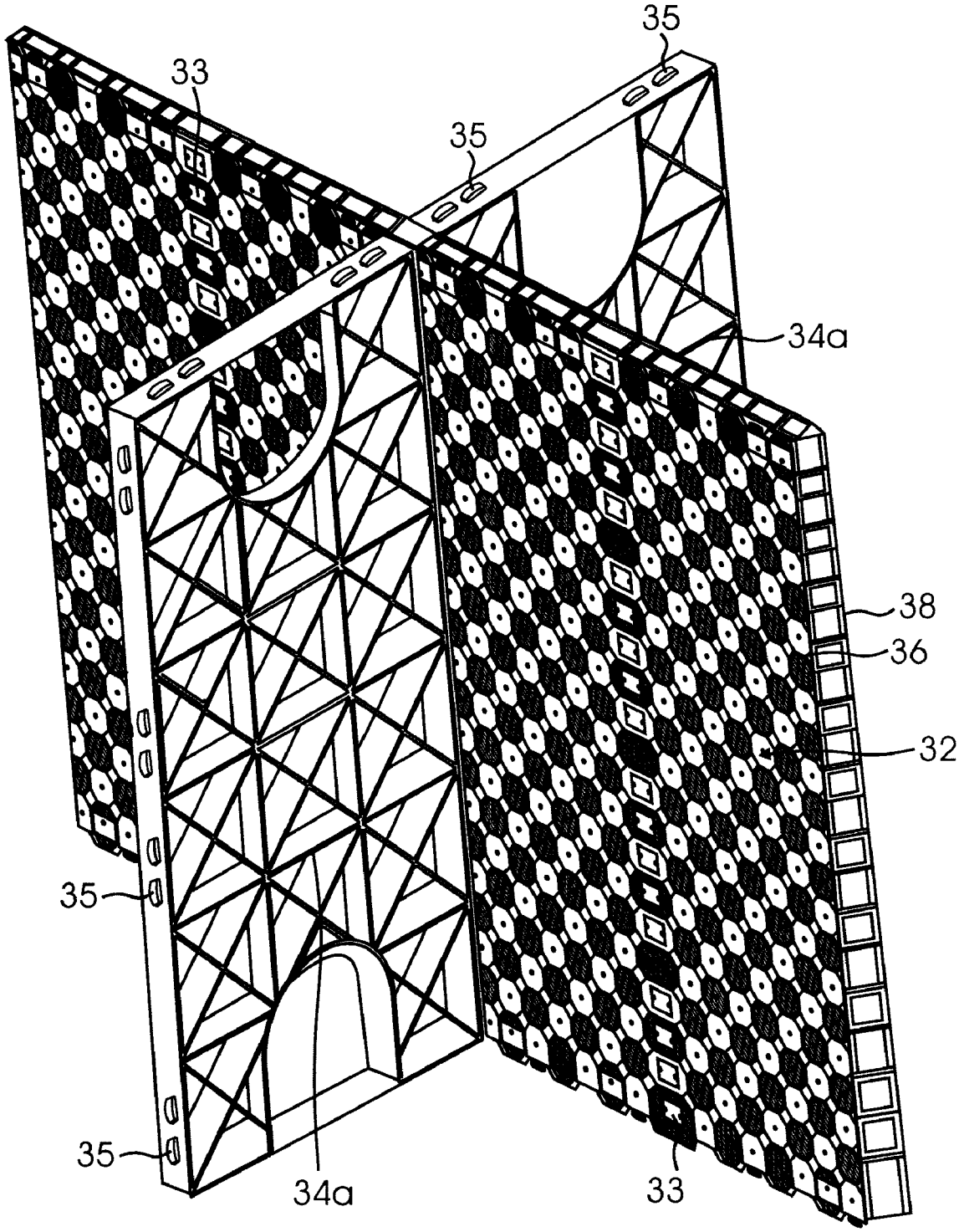
FIG. 11*a* is a perspective view of a partially assembled raintank module, showing two cross plates attached to one modular cell plate.
Figure 11B:
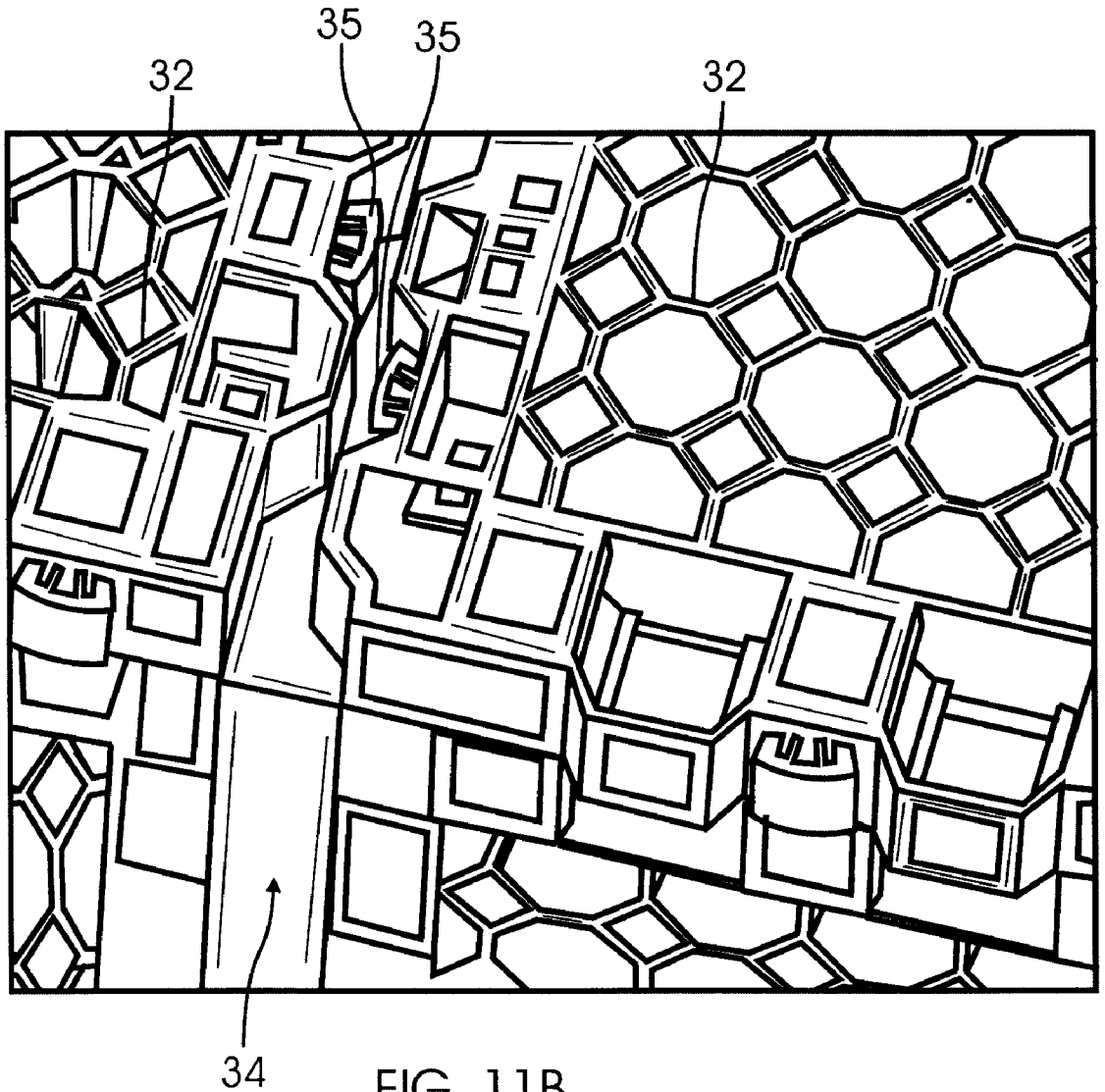
FIG. 11*b* is a perspective view of a partially assembled raintank module, showing in detail the connection between modular cell plates and an end plate.

FIG. 11*a*-11*f* illustrate the step-by-step assembly of tank module 30. Referring to FIG. 11*a*, two cross plates 34*a* are attached to modular cell plate 32. In the embodiment illustrated in FIGS. 11*a*-11*f*, cell plate 32 is shown as having a pattern of support surfaces identical to cell plate 1 of FIG. 1A. One cross plate 34*a* is attached to the top planar member 36 and the other cross plate 34*a* is attached to the bottom planar member 38.

The cross plates 34*a* are connected to the modular plate 32 by locking members 35, which are preferably identical to locking members 12 of cross plate 22 in FIG. 7. The locking members 35 of cross plates 34*a* interlock with matching locking slots (cut outs) 33 in plate 32. As can be seen, cell plate 32 includes three rows of locking slots 33 (identified as 33*a*, 33*b*, and 33*c* in FIG. 11*d*), allowing not one but three cross plates 34*a* to be attached to each side of cell plate 32 in order to increase the strength of the assembled tank module.

Figure 11C:
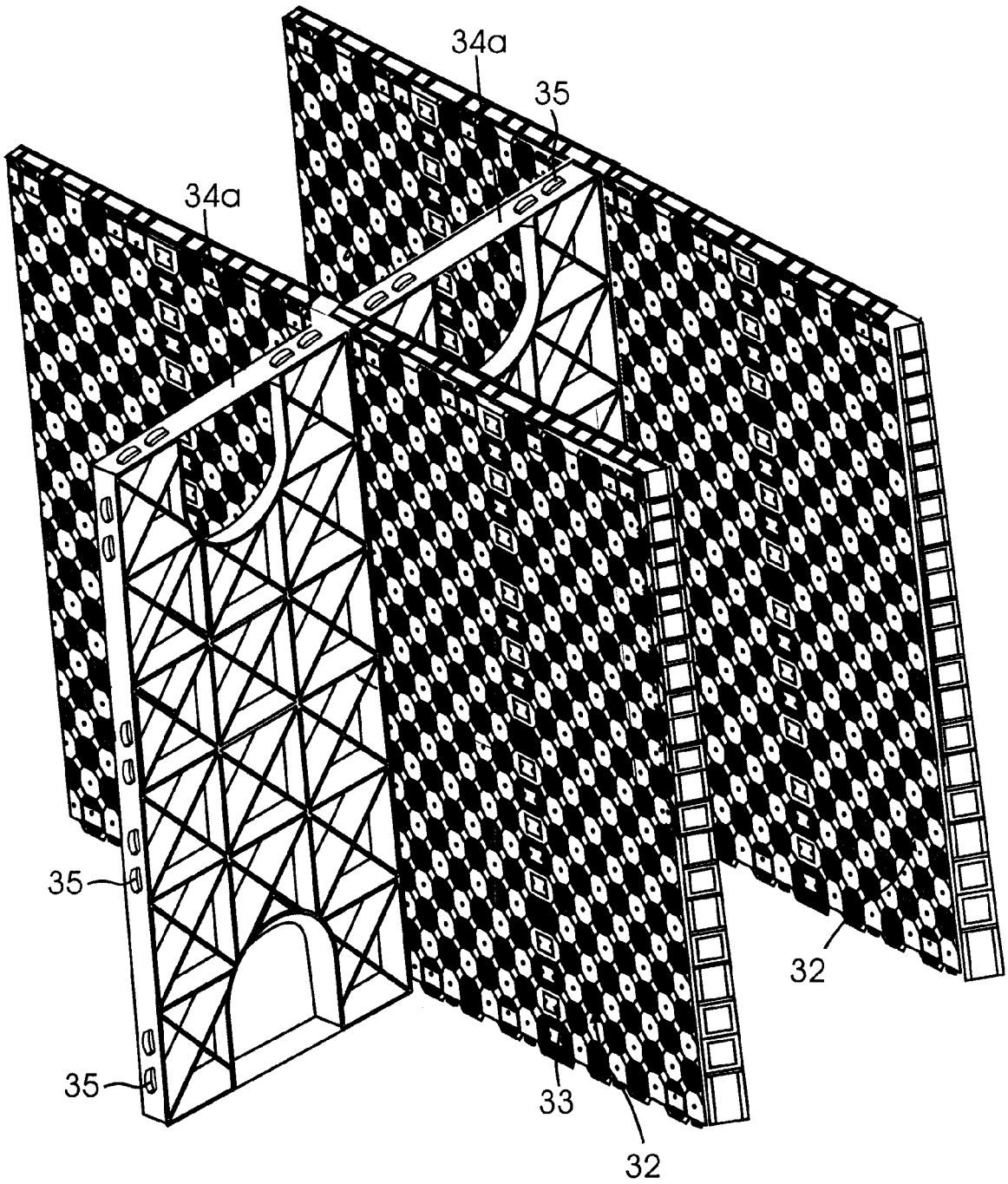
FIG. 11*c* is a perspective view of a partially assembled raintank module, showing two cross plates attached to two modular cell plates.
Figure 11D:
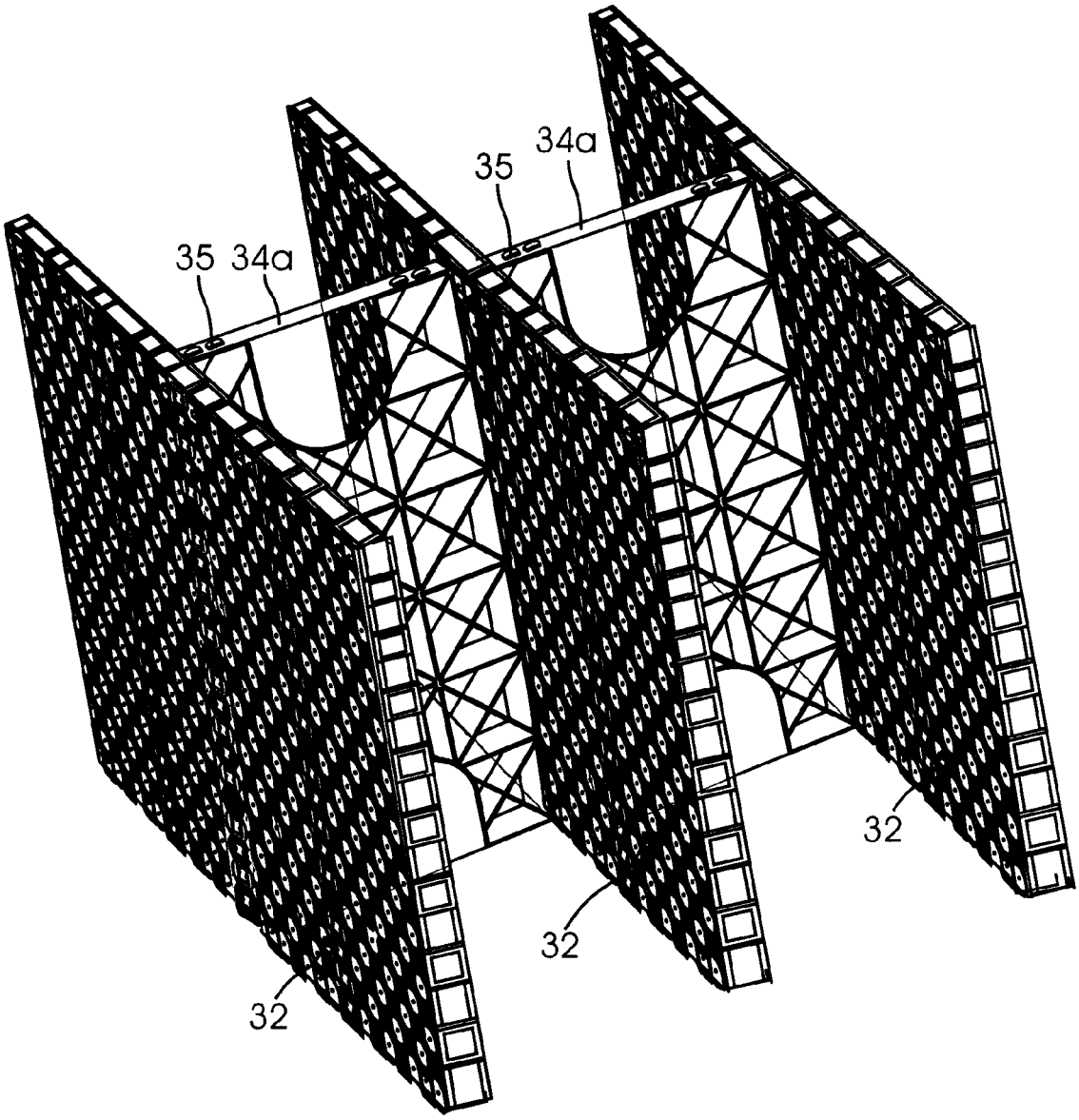
FIG. 11*d* is a perspective view of a partially assembled raintank module, showing the connection between three modular cell plates and two cross plates.

Referring to FIG. 11*c* and 11*d* respectively, a second modular cell plate 32 is attached to one of the cross plates 34*a*, and a third modular plate 32 is attached to the other one of the cross plates 34*a*. Once again, the attachment of cross plates 34*a* to modular plates 32 is facilitated by locking members 35 of cross plates 34*a* interlocking with corresponding locking slots 33 of modular cell plates 32.

Figure 11E:
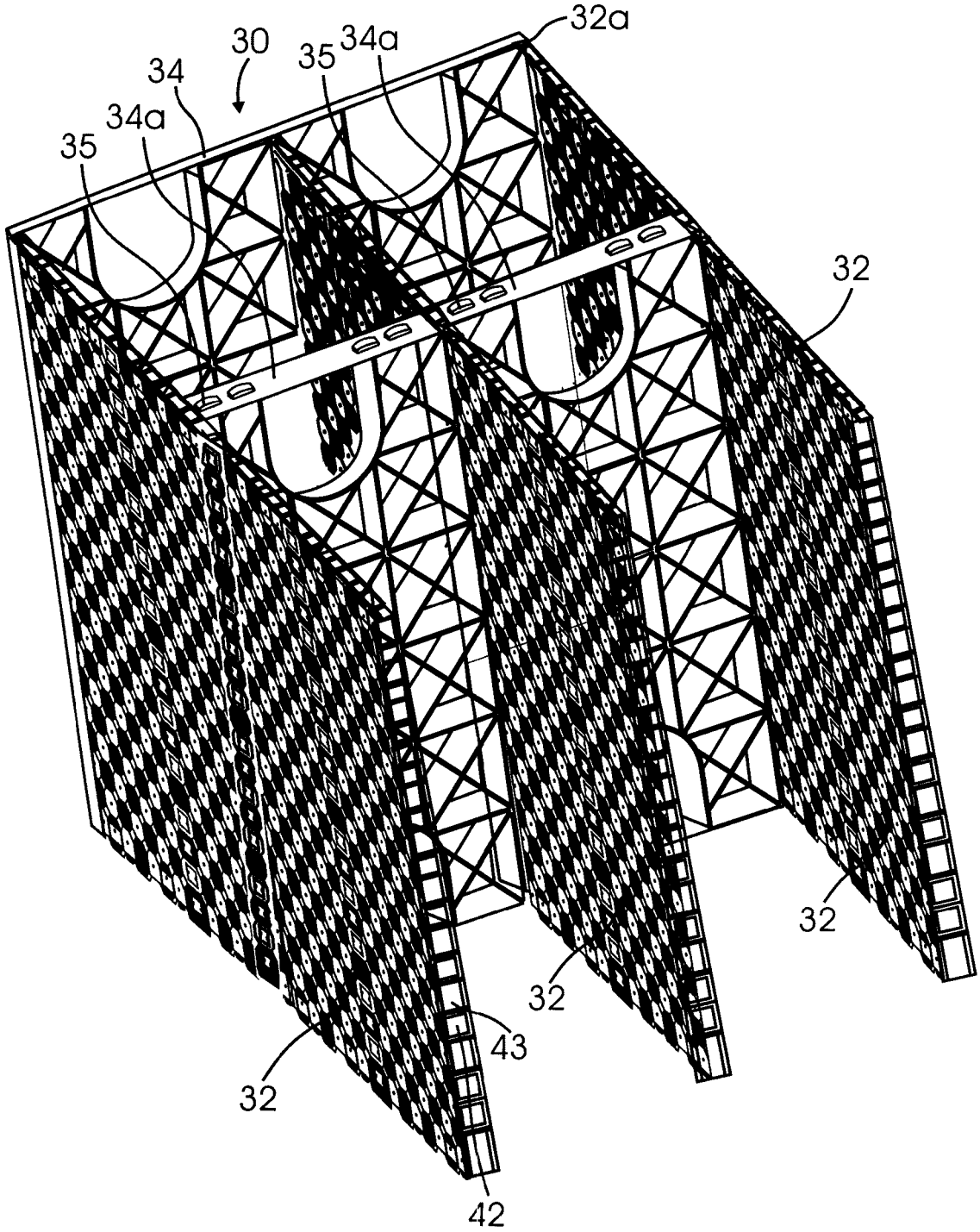
FIG. 11*e* is a perspective view of a partially assembled raintank module, showing the connection between three modular cell plates two cross plates, and one end plate.
Figure 11F:
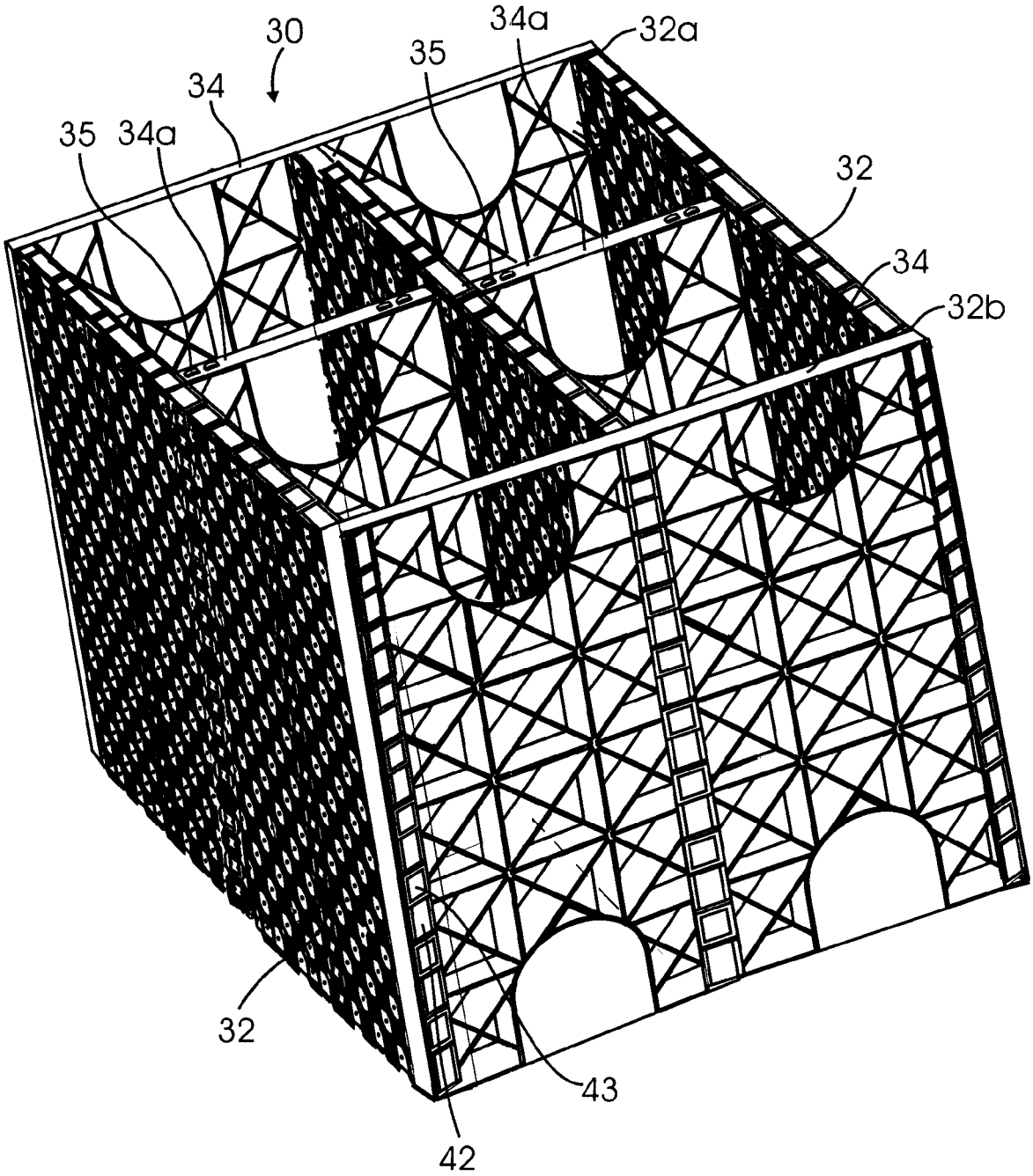
FIG. 11*f* is a perspective view of a partially assembled raintank module, showing the connection between three modular cell plates, two cross plates, and two end plates.

Referring to FIG. 11*e*, one end plate 34 is attached to all three modular cell plates 32 at their one end 32*a*. Referring to FIG. 11*f*, another end plate 34 is attached to all three modular cell plates 32 at their other end 32*b*. The end plate 34 attaches to cell plates 32 when the three rows 41*a*, 41*b*, 41*c* of locking lip members 41 of end plate 34 interlock with the matching locking members 42 and periphery wall members 43 of cell plates 32. The interlocking of locking members 42 and periphery wall members 43 of cell plates 32 with locking lip members 41 of end plate 34 provides much stronger structural support for the tank module than would an interlocking configuration of protruding locking members (as for example locking members 12 of plate 22 in FIG. 7) with matching cutouts.

In the final step of assembly, a fourth modular cell plate 32 is attached to the top side of all three modular cell plates 32 and a fifth modular cell plate 32 is attached to the bottom side of all three modular cell plates 32, forming an assembled tank module 30, as illustrated in FIG. 10A. The fourth and fifth modular plates 32 attach by interconnecting with of the first three modular plates 32, as shown in detail in FIG. 10*c*.

Figure 12:
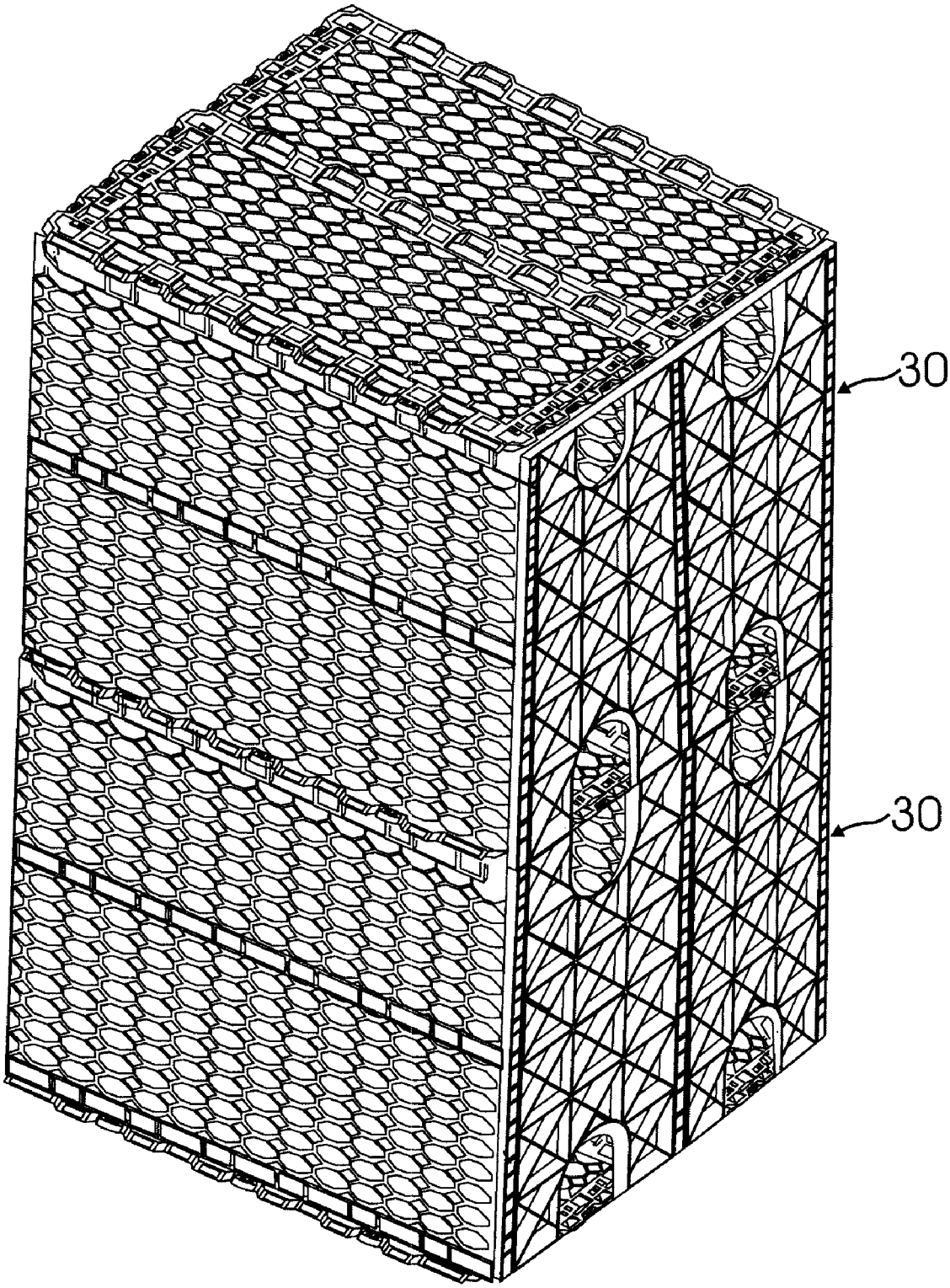
FIG. 12 is a perspective view of two fully assembled raintank modules, stacked one on top of another.

Assembled tank modules can be connected with each other to form a water storage network of any required size. Tank modules can be stacked on top of each other as shown in FIG. 12.

In addition, as explained earlier, multiple tank modules can be constructed side by side, utilizing end plate 34 as a common sidewall. For example, one tank module could have six other tank modules attached to it, i.e., one tank module on each one of its six sidewalls. FIGS. 13*a*-13*c* illustrate by way of example how a second tank module is assembled on one sidewall of a first tank module. As can be seen in FIGS. 13*a*-13*c*, the second tank module 30*b* shares a sidewall (end plate 34) with the first module 30*a*. A third tank module (not shown) could be attached in a similar way to the second tank module and share one sidewall with the second tank module. Such a wall sharing arrangement between connected tank modules saves a significant amount of plastic material.

It should be obvious to people skilled in the art that modifications and alterations can be made to the above embodiments without departing from the spirit of the present invention.

The invention is to be determined by the following claims:

I claim:

1. A modular raintank structure comprising:

a plurality of sidewall plate modules, said sidewall plate modules interconnected to form a box-shaped raintank with a hollow interior space;

a plurality of cross plates extending within the hollow interior space of said raintank between opposing sidewall plate modules;

each said sidewall plate module comprising a first planar member having an alternating pattern of support surfaces and openings, and a second planar member spaced from and substantially parallel to said first planar member, said second planar member having an alternating pattern of support surfaces and openings, with each opening of said second planar member being aligned with a support surface of said first planar member, and with each support surface of said second planar member being aligned with an opening of said first planar member;

a plurality of joining members connecting the support surfaces of said first planar members to adjacent support surfaces of said second planar members;

each of said cross plates including a skeletal framework of a plurality of interconnecting struts, said struts having openings therebetween;

wherein water can freely flow into and out of said modular raintank through said openings of the first and second planar members and through the openings of the cross plates.

2. The modular raintank structure of claim 1, wherein a plurality of said interconnecting struts are nonparallel to each other.

3. A modular water storage system comprising:

a plurality of interconnected raintank modules, each of said raintank modules having a plurality of external sidewall plate modules forming a box-like shape with a hollow interior;

each raintank module including a plurality of cross plates extending within the hollow interior of said raintank module between opposing sidewall plate modules;

each said sidewall plate module comprising a first planar member having an alternating pattern of support surfaces and openings, and a second planar member spaced from and substantially parallel to said first planar member, said second planar member having an alternating pattern of support surfaces and openings, with each opening of said second planar member being aligned with a support surface of said first planar member, and with each support surface of said second planar member being aligned with an opening of said first planar member;

a plurality of joining members connecting the support surfaces of said first planar members to adjacent support surfaces of said second planar members;

each of said cross plates including a skeletal framework of a plurality of interconnecting struts, said struts having openings therebetween; and wherein water can freely flow into and out of said modular raintank through said openings of the first and second planar members and through the openings of the cross plates.

4. The modular storage system of claim 3, wherein at least two of said interconnected raintank modules share a sidewall.

5. The modular storage system of claim 3, wherein at least one said raintank module is stacked on top of another said raintank module.

6. The modular water storage system of claim 3, farther comprising an end plate, the end plate comprising peripheral edge members and a plurality of thin struts extending from and back to at least one of said edge members, forming a plurality of openings between said thin struts and said edge members.

7. The modular water storage system of claim 6, wherein said thin struts are U-shaped.

8. A modular plate member for forming an underground infiltration or storage system, comprising:

a first planar member having an alternating pattern of support surfaces and openings;

a second planar member spaced from and substantially parallel to said first planar member, said second planar member having an alternating pattern of support surfaces and openings, with each opening of said second planar member being aligned with a support surface of said first planar member, and with each support surface of said second planar member being aligned with an opening of said first planar member;

a plurality of joining members connecting the support surfaces of said first planar members to adjacent support surfaces of said second planar members;

a periphery wall extending between said first and second planar members, said periphery wall including a plurality of first openings and a plurality of outwardly extending locking members;

a plurality of second openings in at least one of said support surfaces of said first and second planar members, wherein said locking members of said periphery wall of a first modular plate member pass through and lock behind said first or second openings in a second modular plate member to securely lock said two modular plate members together.

9. The modular plate member of claim 8, wherein the locking members have side protrusions which lock behind said first and second openings to resist separation of said modular plate members.

10. The modular plate member of claim 8, further comprising a central row of support surfaces, said support surfaces including a plurality of openings which are adapted to receive locking members of a second modular plate member.

11. The modular plate member of claim 8, wherein said openings and support surfaces of said first planar member are arranged in a checkerboard like pattern.

12. The modular plate member of claim 11, wherein said openings and support surfaces of said second planar member are arranged in a checkerboard like pattern.

13. A modular plate member for forming an underground rainwater infiltration or storage system, comprising:

a first planar member having an alternating pattern of openings and octagonal support surfaces;

a second planar member spaced from and substantially parallel to said first planar member, said second planar member having an alternating pattern of openings and octagonal support surfaces, with each opening of said second planar member being aligned with an octagonal support surface of said first planar member and with each octagonal support surface of said second planar member being aligned with an opening of said first planar member;

a plurality of columnar members interconnecting said first and second planar members proximally to corners of said octagonal support surfaces of said first and second planar members;

a periphery wall extending between said first and second planar members, said periphery wall including a plurality of first openings, a plurality of second openings located in at least one of the support surfaces of said first and second planar members;

a plurality of locking members extending outwardly from said periphery wall and having laterally extending protrusions; and wherein the locking members and the protrusions of one modular plate member pass through and lock behind the first or second openings in a second modular plate member to securely lock said two modular plate members together.

14. The modular plate member of claim 13, wherein the openings and octagonal support surfaces of said first planar member are arranged in a checkerboard like pattern.

15. The modular plate member of claim 14, wherein the openings and the octagonal support surfaces of said second planar member are arranged in a checkerboard like pattern.

16. The modular plate member of claim 13, wherein said protrusions are wider than said first and second openings.

* * * * *